US009480387B2

(12) United States Patent
Beshears, Jr. et al.

(10) Patent No.: US 9,480,387 B2
(45) Date of Patent: Nov. 1, 2016

(54) DISHWASHER DETERGENT DISPENSER

(71) Applicant: WHIRLPOOL CORPORATION, Benton Harbor, MI (US)

(72) Inventors: Paul E. Beshears, Jr., Stevensville, MI (US); Elliott V. Stowe, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/870,918

(22) Filed: Sep. 30, 2015

(65) Prior Publication Data

US 2016/0015243 A1 Jan. 21, 2016

Related U.S. Application Data

(63) Continuation of application No. 14/492,632, filed on Sep. 22, 2014, now Pat. No. 9,167,952, which is a continuation of application No. 13/718,078, filed on Dec. 18, 2012, now Pat. No. 8,881,748.

(51) Int. Cl.
*A47L 15/44* (2006.01)
*A47L 15/42* (2006.01)

(52) U.S. Cl.
CPC ..... *A47L 15/4418* (2013.01); *A47L 15/4217* (2013.01); *A47L 15/4219* (2013.01); *A47L 15/4409* (2013.01); *A47L 15/4214* (2013.01)

(58) Field of Classification Search
CPC ..... A47L 15/4409; A47L 15/4219; A47L 15/4445; A47L 15/4463; A47L 15/4217
USPC ..... 134/25.2, 93, 56 D, 99.2, 18, 198, 58 D, 134/178, 200, 26, 176, 29, 95.1, 103.3; 222/1, 129, 651, 173, 504, 52, 160, 222/325, 505, 652
See application file for complete search history.

(56) References Cited

U.S. PATENT DOCUMENTS

2006/0144424 A1* 7/2006 Marchitto ..... A47L 15/4409 134/25.2
2013/0087173 A1* 4/2013 Welch ..... A47L 15/4445 134/25.2
2013/0098406 A1* 4/2013 Beshears, Jr. ..... A47L 15/44 134/25.2

* cited by examiner

*Primary Examiner* — David Cormier
*Assistant Examiner* — Thomas Bucci

(57) ABSTRACT

A dispenser for a dishwasher having a wash tub includes a fluid reservoir to hold a treating chemistry, a lid operatively mounted to the fluid reservoir, and configured to move between an open position and a closed position, and a hydraulic actuator fluidly coupled to a fluid source and configured to initiate movement of the lid between its closed and the open positions in response to fluid pressure applied to the actuator by the fluid source. The dispenser is configured to be mounted at more than one location in the wash tub.

12 Claims, 4 Drawing Sheets

DISHWASHER DETERGENT DISPENSER

RELATED APPLICATION(S)

This application is a continuation of U.S. patent application Ser. No. 14/492,632 filed on Sep. 22, 2014, now U.S. Pat. No. 9,167,952, which is a continuation of U.S. patent application Ser. No. 13/718,078, filed on Dec. 18, 2012, now U.S. Pat. No. 8,881,748, issued Nov. 11, 2014, the entireties of which are incorporated herein by reference.

BACKGROUND OF THE INVENTION

Most contemporary dishwashers for use in a typical household include a wash tub for storing utensils during a wash cycle in which the stored utensils are cleaned. A dispensing system may be provided for dispensing chemistry as part of the cycle of operation. Contemporary dishwasher dispensers use an electromechanical actuator such as a solenoid or a wax motor. Electromechanical dispensers are typically mounted on the door of a dishwasher, which requires a large hole in the dishwasher interior creating the possibility of leaks. Additionally, wiring must be routed to the dispenser and actuator. The actuator is located outside of the dishwasher interior, so a perimeter gasket must be used along with a set of screws to mount the dispenser to the door.

At the start of the washing operation, the door assembly is opened, the dispenser is loaded, and, after loading the dishes, the door assembly is closed. During the washing operation, an electromechanical mechanism opens the dispenser allowing detergent to fall into the dishwasher. A controller may be operably connected with the dispensing system and various other components of the dishwasher to execute the cycle of operation.

BRIEF DESCRIPTION OF THE INVENTION

In one embodiment, a dispenser for a dishwasher having a wash tub includes a fluid reservoir to hold a treating chemistry, a lid operatively mounted to the fluid reservoir where the lid is configured to move between an open position and a closed position; and a hydraulic actuator fluidly coupled to a fluid source external to the wash tub. The hydraulic actuator is configured to initiate movement of the lid between its closed and the open positions in response to fluid pressure applied to the actuator by the fluid source. The dispenser is configured to be mounted at more than one location in the wash tub.

In a second embodiment a dishwasher is configured to execute at least one automatic cycle of operation for treating dishes. The dishwasher includes a tub at least partially defining a treating chamber with an open face for receiving dishes for treatment, a moveably mounted door movable between an opened position for providing access to the treating chamber and a closed position for selectively closing the open face of the treating chamber during the dishwashing cycle, and a dispenser selectively disposed within the tub at any one of a plurality of locations in the tub.

DESCRIPTION OF EMBODIMENTS OF THE INVENTION

Figure 1:
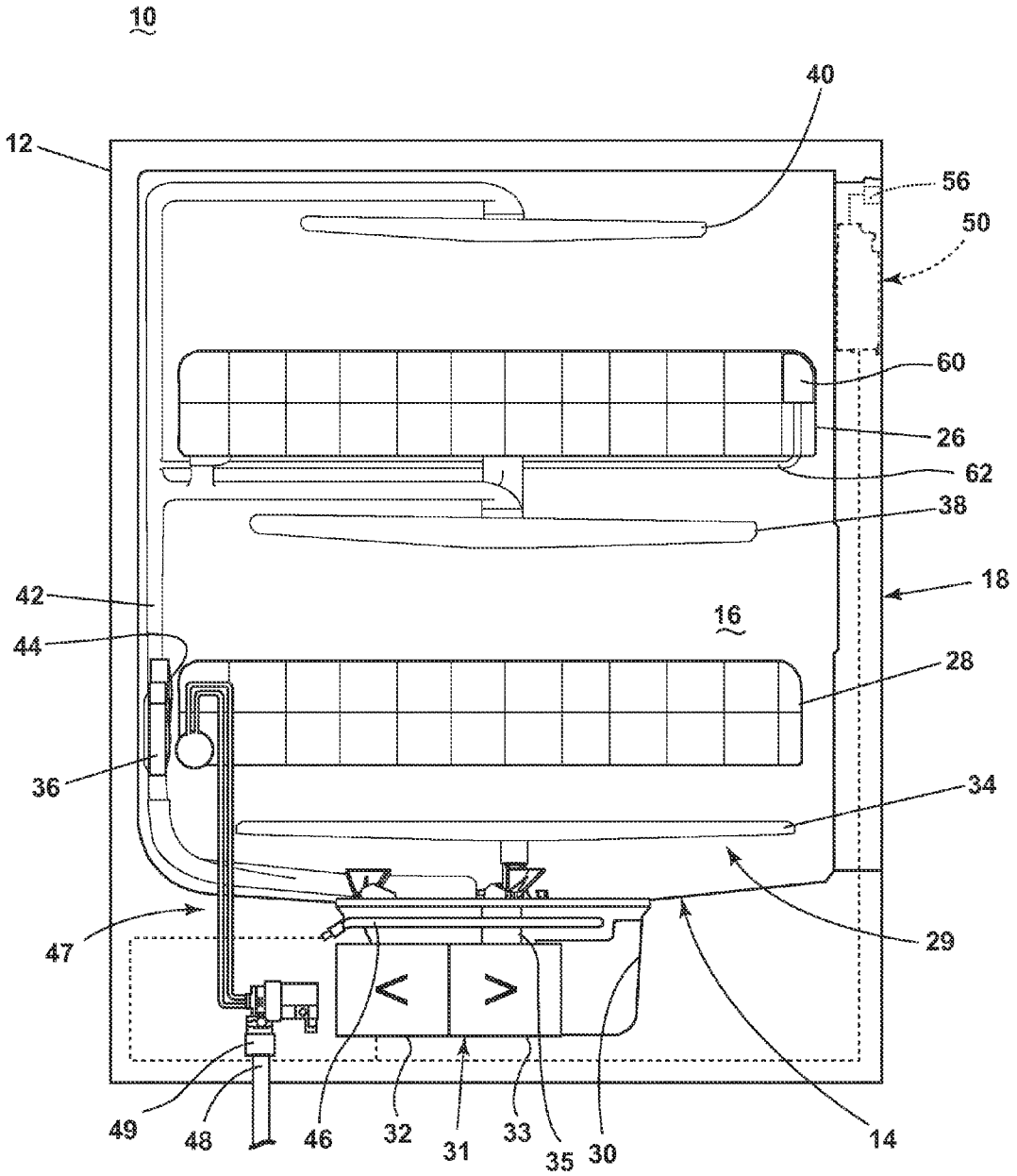
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, utensils, plates, pots, bowls, pans, glassware, and silverware.

A spray system 29 is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system 29. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and pump the liquid to the spraying system 29 to supply liquid into the treating chamber 16. While the pump assembly 31 is illustrated as having separate drain and recirculation pumps 32, 33 in an alternative embodiment, the pump assembly 31 may include a single pump configured to selectively supply wash liquid to either the spraying system 29 or the drain line, such as by configuring the pump to rotate in opposite directions, or by providing a suitable valve system. A liquid supply system 47 may include a water supply conduit with water supply inlet valve 49 coupled with a household water supply 48 for supplying water.

As shown herein, the recirculation pump 33 has an outlet conduit 35 in fluid communication with the spraying system 29 for discharging wash liquid from the recirculation pump 33 to the sprayers 34, 36, 38, and 40. As illustrated, liquid may be supplied to the spray manifold 36, mid-level rotatable sprayer 38, and upper sprayer 40 through a supply tube 42 that extends generally rearward from the recirculation pump 33 and upwardly along a rear wall of the tub 14. While the supply tube 42 ultimately supplies liquid to the spray manifold 36, mid-level rotatable sprayer 38, and upper sprayer 40, it may fluidly communicate with one or more manifold tubes that directly transport liquid to the spray manifold 36, mid-level rotatable sprayer 38, and upper sprayer 40. Further, diverters (not shown) may be provided within the spraying system 29 such that liquid may be selectively supplied to each of the sprayers 34, 36, 38, and 40. The sprayers 34, 36, 38, and 40 spray water and/or treating chemistry onto the dish racks 26, 29 (and hence any utensils positioned thereon) to effect a recirculation of the liquid from the treating chamber 16 to the liquid spraying system 29 to define a recirculation flow path.

A heating system including a heater 46 may be located within the sump 30 for heating the liquid contained in the sump 30.

A dispenser 60 may be disposed in the treating chamber 16. In FIG. 1, the dispenser 60 is illustrated as mounted on the upper rack 26, however, in an alternate embodiment, the dispenser 60 may be located elsewhere in the treating chamber including, but not limited to the lower rack 28 and the top of the tub 14. The dispenser may be fluidly coupled to recirculation pump 33 by a dispenser supply tube 62. Dispenser supply tube 62 may be fluidly coupled directly to the recirculation pump 33 or it may be fluidly coupled to the supply tube 42 or one or more of manifold tubes that transport liquid to the spray manifold 36, mid-level rotatable sprayer 38, and upper sprayer 40.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
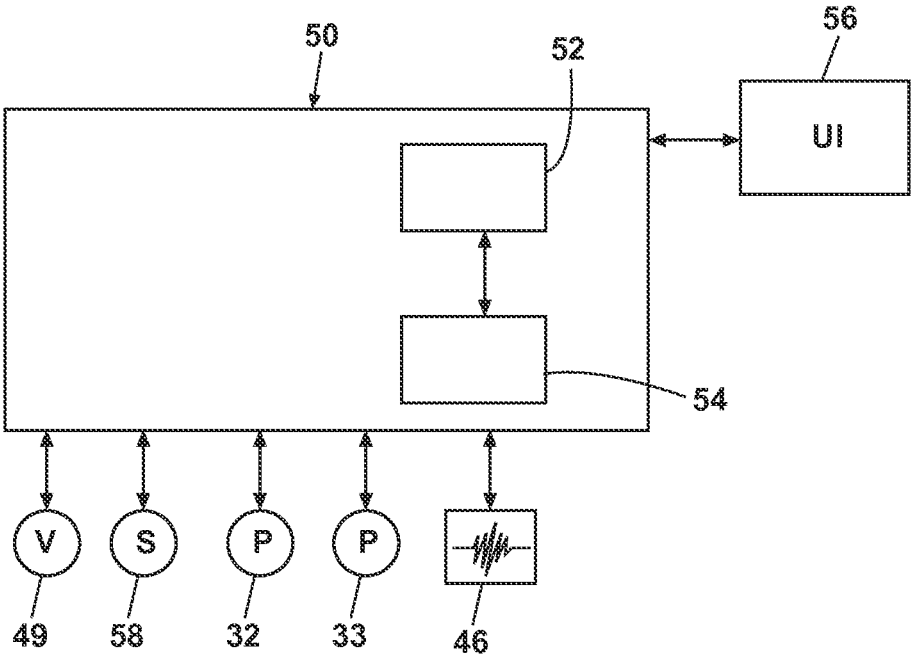
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, the recirculation pump 33 for recirculating the wash liquid during the cycle of operation, and the water supply inlet valve 49 for allowing water from the household water supply 48 into the dishwasher 10. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
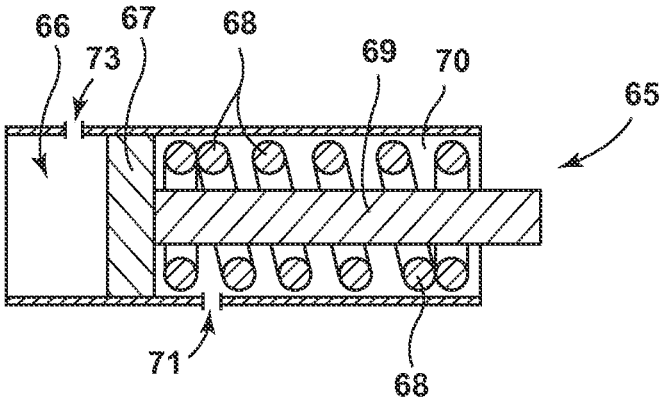
FIG. 3 is an illustration back view of a hydraulic cylinder that can be used to actuate a dispenser according to a first embodiment of the invention

Referring to FIG. 3 a hydraulic cylinder 65 that can be used to actuate a dispenser 60 according to a first embodiment of the invention may include an end chamber 66, a piston 67, spring 68, a piston rod 69, a piston rod chamber 70, and a bleed port 71. Preferably, the piston 67 is made of plastic, but other materials can be used. The piston 67 is sized in order to create enough force to overcome the pressure of the spring 68, which retains the piston in a neutral position. The force on the piston 67 equals the pressure in the hydraulic cylinder 65 times the area of the piston 67. Lower water pressure will require a larger piston area. The hydraulic cylinder 65 also includes an inlet 73 in the end chamber 66. The inlet 73 is fluidly connected to the recirculation pump 31 via dispenser supply tube 62 (see FIG. 1). A bleed port 71 is located in the piston rod chamber 70. A second bleed port (not shown) may be located in the end chamber 66 or in the piston 67.

Figure 4:
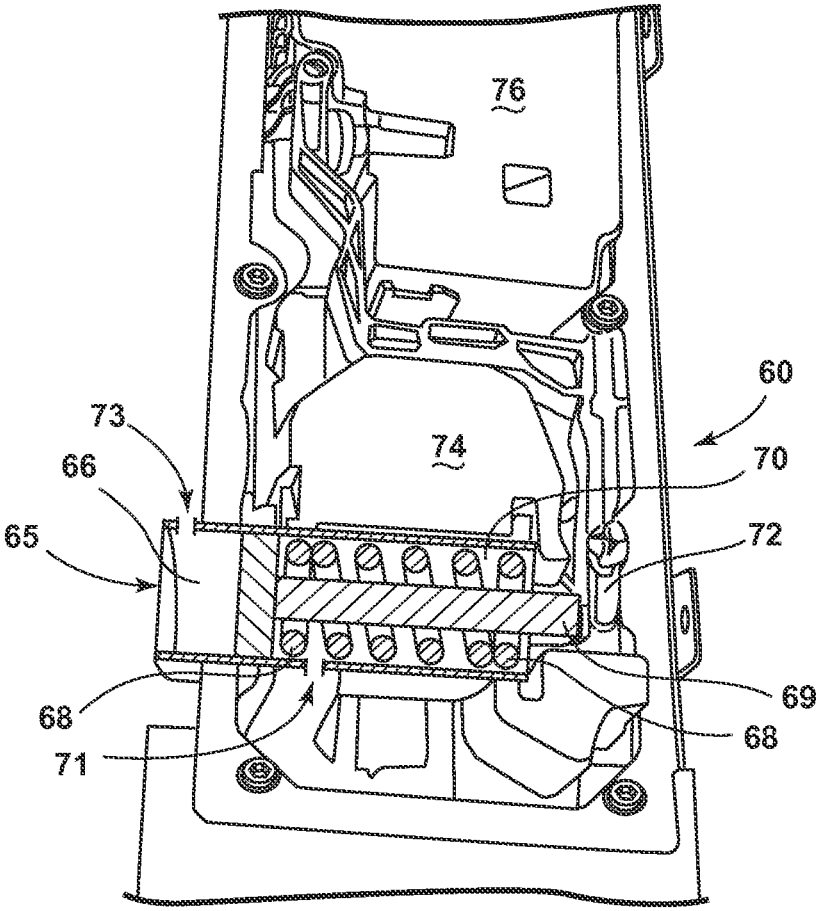
FIG. 4 is a back view of a hydraulically actuated dispenser according to a first embodiment of the invention.

FIG. 4 shows a back view of a dispenser 60 according to a first embodiment of the invention. The dispenser 60 may include at least one storage chamber or cavity 74 dimensioned to hold an additive such as detergent or rinse aid. The storage chamber 74 may comprise a reservoir (not shown) defined by front, rear, bottom, and opposing side walls. In the embodiment of FIG. 4, a second storage chamber 76 for a second quantity of detergent or other additive is provided. The second storage chamber 76 may comprise a reservoir (not shown) defined by front, rear, bottom, and opposing side walls. The hydraulic cylinder 65 can be attached to the dispenser 60 by any known means. The hydraulic cylinder 65 may be positioned such that, when actuated, the piston rod 69 pushes a lever 72. The lever 72 is attached to the dispensing mechanism.

The dispenser 60 may also include a cover assembly (not shown). The cover assembly may include at least one lid that is operatively mounted to the storage chamber 74 and configured to move between a first position wherein the lid closes the storage chamber 74 and a second position wherein the lid is displaced from the storage chamber 74. It should be appreciated that the cover assembly may be secured to any of the front, rear, bottom, or opposing side walls of the storage chamber 74 via a hinge assembly (not shown) configured to pivot the cover assembly. When the cover assembly is closed, user access to the storage chamber 74 may be prevented and an additive may be retained in the storage chamber 74, whereas user access to the storage chamber 74 may be permitted when the cover assembly is open. When the cover assembly opens during washing operation, additive is released into the wash tub 14.

In one embodiment, the lid is rotatably movable for uncovering the storage chamber 74. The dispenser 60 may include a latch assembly (not shown) operatively attached to the storage chamber. The latch assembly may be configured to retain the lid in the first position and to disengage the lid. The cover latches by known means. A variety of dispensers, lids, and latches are known in the art. When the piston rod 69 pushes lever 72, the latch assembly is activated, and the lid is disengaged. The dispenser 60 may include a mechanism (not shown) by which pushing lever 72 a first time disengages the lid on the storage chamber, and pushing the lever 72 a second time actuates a second latch assembly (not shown), which disengages a lid (not shown on the second storage chamber 76. It should be noted that the dispenser could include additional storage chambers and lids for additional detergents and/or additives.

In use, the dispenser 60 is loaded prior to the start of the washing operation. For the first embodiment as shown in FIG. 1, an inlet 73 to the hydraulic cylinder 65 is located in the end chamber 66 and is fluidly connected to the recirculation pump 31 via dispenser supply tube 62. At a predetermined time in a washing operation, the controller 50 signals the recirculation pump 31 to pump a regulated flow of wash fluid to the inlet 73 of the end chamber 66 of the hydraulic cylinder 65 until enough pressure is built to overcome the force of the spring 68 and move the piston 67. In FIG. 4, the piston 67 is shown in its neutral state. In an extended state (not shown), the piston rod 69 pushes lever 72 to actuate the latch assembly so as to release the lid to the dispenser 60 thereby releasing detergent or other additive into the tub 16. In the extended state, the piston 67 is positioned such that the bleed port 71 is in fluid communication with the end chamber 66. Liquid can exit the hydraulic cylinder 65 through the bleed port 71 to prevent an over-pressure condition. The second bleed port (not shown), which may be located in the end chamber 66 or the piston 67 allows liquid to exit the hydraulic cylinder 65 after the dispenser 60 has been actuated. As liquid exits the end chamber 66, the pressure of the spring 68 is sufficient to return the piston 67 to a neutral state.

Figure 5:
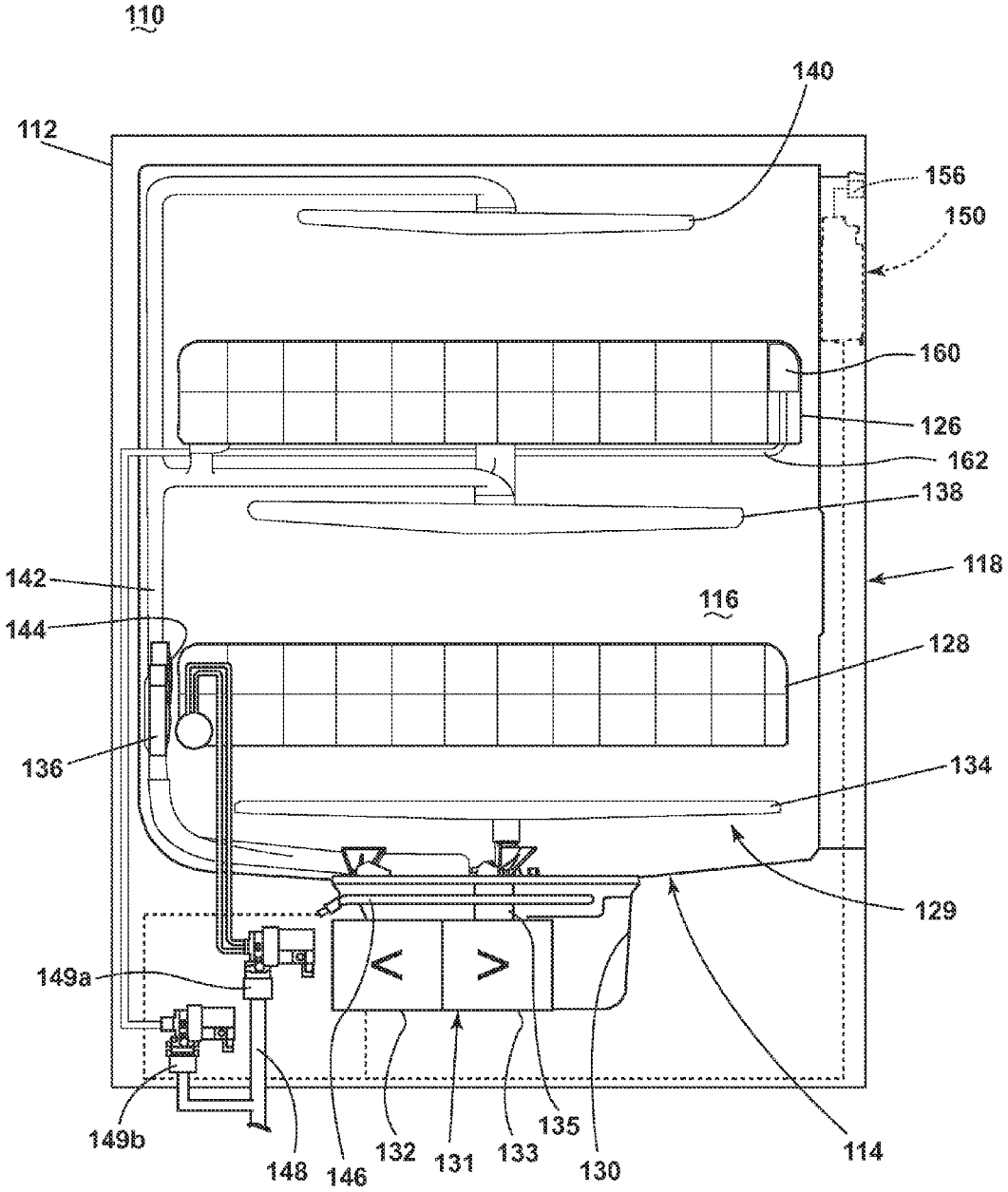
FIG. 5 is a schematic, cross-sectional view of a dishwasher according to a second embodiment of the invention.

In FIG. 5, an automated dishwasher 110 according to a second embodiment is illustrated. Many components of the dishwasher 110 of the second embodiment are the same as in the first embodiment illustrated in FIG. 1. Like elements are numbered with the same reference number increased by 100. For the second embodiment of the invention, the dispenser 160 may be disposed in the treating chamber 116. In FIG. 5, the dispenser 160 is illustrated as mounted on the upper rack 126, however, in an alternate embodiment, the dispenser 160 may be located elsewhere in the treating chamber including, but not limited to the lower rack 128 and the top of the tub 116. The dispenser may be fluidly coupled to the household water supply 148 by a dispenser supply tube 162. A water supply inlet valve 149*a* may be provided in the household water supply 148 to control the flow of water into the dishwasher. A water supply dispenser inlet valve 149*b* may be provided in the household water supply 148 to control the flow of water to the dispenser 160. Dispenser supply tube 162 may be a small diameter semi-rigid tube, but other materials are envisioned. Household water has a higher pressure (approximately 20-120 psi) than wash liquid generated by the recirculation pump 133 (approximately 2 psi), so one advantage of this embodiment is that a smaller piston 67 (see FIG. 3) is needed to generate the necessary force to actuate the dispenser 160. Because domestic water pressure can range upwards of 120 psi, it may be desirable to include a pressure regulator (not shown) in the dispenser supply tube 162 between the water supply dispenser inlet valve 149 and the dispenser 160. The bleed port 71 may function as a siphon-break, which prevents backflow of liquid into the household water supply. In an alternate embodiment, two check valves in series in the wash fluid supply in conjunction with a pressure regulator prevent backflow of wash fluid.

In use, for the second embodiment as shown in FIG. 5, an inlet 73 to the hydraulic cylinder 65 (see FIG. 3) is fluidly connected to the household water supply 148 via dispenser supply tube 162. The controller 50 opens the water supply dispenser inlet valve 149 at a predetermined time in a washing operation to allow water from the household water supply 148 to flow to the dispenser 160. Water from the household water supply 148 flows to the inlet 73 of the end chamber 66 (see FIG. 3) of the hydraulic cylinder 65 until enough pressure is built to overcome the force of the spring 68 and move the piston 67. The hydraulic cylinder 65 may be set to actuate at varying pressures. In one embodiment, the hydraulic cylinder 65 actuates at 15 psi.

In FIG. 4, the piston 67 is shown in its neutral state. In an extended state (not shown), the piston rod 69 pushes lever 72 to actuate the latch assembly so as to release the lid to the dispenser 160 thereby releasing detergent or other additive into the tub 116. In the extended state, the piston 67 may be positioned such that the bleed port 71 is in fluid communication with the end chamber 66. Liquid can exit the hydraulic cylinder 65 through the bleed port 71 to prevent an over-pressure condition.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dispenser for a dishwasher having a wash tub, the dispenser comprising:

a fluid reservoir to hold a treating chemistry;

a lid operatively mounted to the fluid reservoir, and configured to move between an open position and a closed position; and a hydraulic actuator configured to be fluidly coupled to a fluid source external to the wash tub, and configured to initiate movement of the lid between the closed and the opened positions in response to fluid pressure applied to the hydraulic actuator by the fluid source external to the wash tub; and wherein the dispenser is configured to be mounted at more than one location in the wash tub.

2. The dispenser of claim 1, wherein the wash tub has a treating chamber and the dispenser is configured to be mounted at more than one location in the treating chamber.

3. The dispenser of claim 2, wherein the treating chamber has a lower rack, an upper rack and a top, and the dispenser is configured to be mounted at any one of the lower rack, the upper rack or the top.

4. The dispenser of claim 3, further comprising a dispenser supply tube for coupling the dispenser to one of a recirculation pump or to at least one manifold tube for transporting liquid to a spray manifold, a mid-level rotatable sprayer, or an upper sprayer depending on the location of the dispenser in the treating chamber.

5. The dispenser of claim 1, wherein the wash tub has a lower rack, an upper rack and a top, and the dispenser is configured to be mounted at any one of the lower rack, the upper rack or the top.

6. The dispenser of claim 1, further comprising a dispenser supply tube for coupling the dispenser to one of a recirculation pump or to at least one manifold tube for transporting liquid to a spray manifold, a mid-level rotatable sprayer, or an upper sprayer depending on the location of the dispenser in the wash tub.

7. A dishwasher configured to execute at least one automatic cycle of operation for treating dishes, the dishwasher comprising:

a tub at least partially defining a treating chamber with an open face for receiving dishes for treatment;

a moveably mounted door movable between an opened position for providing access to the treating chamber and a closed position for selectively closing the open face of the treating chamber during the automatic cycle of operation; and a dispenser selectively disposed within the tub at any one of a plurality of locations in the tub and comprises a fluid reservoir to hold a treating chemistry, a lid operatively mounted to the fluid reservoir and configured to selectively close the fluid reservoir, and a hydraulic actuator fluidly coupled to a fluid source external to the tub and configured to selectively open the lid in response to fluid pressure applied to the hydraulic actuator by the fluid source during the automatic cycle of operation.

8. The dishwasher of claim 7, wherein the tub has a treating chamber and the dispenser is selectively disposed at any one of a plurality of locations within the treating chamber.

9. The dishwasher of claim 8, wherein the treating chamber has a lower rack, an upper rack and a top, and the dispenser is mounted at any one of the lower rack, the upper rack or the top.

10. The dishwasher of claim 9, further comprising a dispenser supply tube for coupling the dispenser to one of a recirculation pump or to at least one manifold tube for transporting liquid to a spray manifold, a mid-level rotatable sprayer, or an upper sprayer depending on the location of the dispenser in the treating chamber.

11. The dishwasher of claim 7, wherein the tub has a lower rack, an upper rack and a top, and the dispenser is configured to be mounted at any one of the lower rack, the upper rack or the top.

12. The dishwasher of claim 7, further comprising a dispenser supply tube for coupling the dispenser to one of a recirculation pump or to at least one manifold tube for transporting liquid to a spray manifold, a mid-level rotatable sprayer, or an upper sprayer depending on the location of the dispenser in the tub.

* * * * *